US005348508A

United States Patent [19]

Garfinkel

[11] Patent Number: 5,348,508

[45] Date of Patent: Sep. 20, 1994

[54] TOY WITH SIMULATED FORCE DISCHARGE

[76] Inventor: Henry A. Garfinkel, 31 Dogwood Rd., Searingtown, N.Y. 11507

[21] Appl. No.: 100,310

[22] Filed: Aug. 2, 1993

[51] Int. Cl.[5] ..... A63H 33/28; A63H 33/30

[52] U.S. Cl. ..... 446/24; 446/438; 446/473; 446/485; 40/407

[58] Field of Search ..... 446/24, 25, 438, 473, 446/485, 475; 239/211; 222/78, 79; 40/406, 407

[56] References Cited

U.S. PATENT DOCUMENTS

| | | | |
|---|---|---|---|
| 1,462,041 | 7/1923 | Meyer | 239/211 |
| 2,413,284 | 12/1946 | Bonanno | 446/25 |
| 2,629,516 | 2/1953 | Badham | 222/79 |
| 4,171,754 | 10/1979 | Rosado | 222/78 X |
| 4,239,129 | 12/1980 | Esposito | 222/79 |
| 4,408,717 | 10/1983 | Rynberk | 239/18 |
| 4,750,641 | 6/1988 | Chin-Fu | 222/79 |
| 4,936,506 | 6/1990 | Ryan | 239/18 |
| 5,018,288 | 5/1991 | Yang | 40/406 |

*Primary Examiner*—Mickey Yu

*Attorney, Agent, or Firm*—Dennison, Meserole, Pollack & Scheiner

[57] ABSTRACT

A toy including a light source for emitting a light beam longitudinally outward of the toy, and a water discharge nozzle directed to intersect the light beam at a low angle thereto outward of the toy to diffuse and reflect the light for simulation of a force or pressure discharge from the toy.

6 Claims, 2 Drawing Sheets

FIG. 1
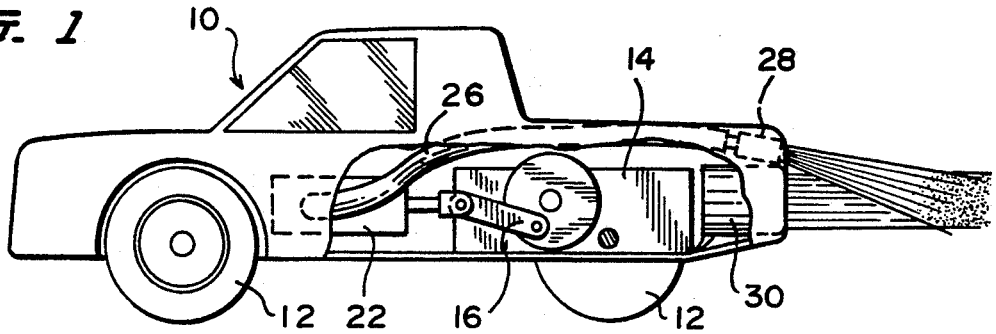
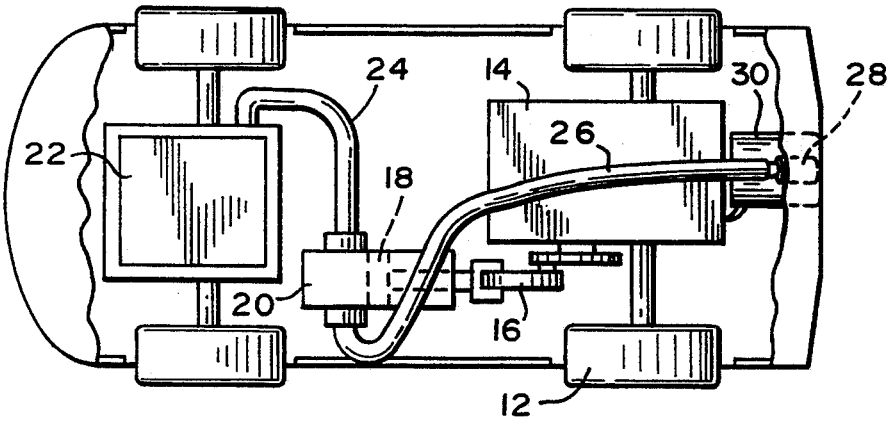
FIG. 2
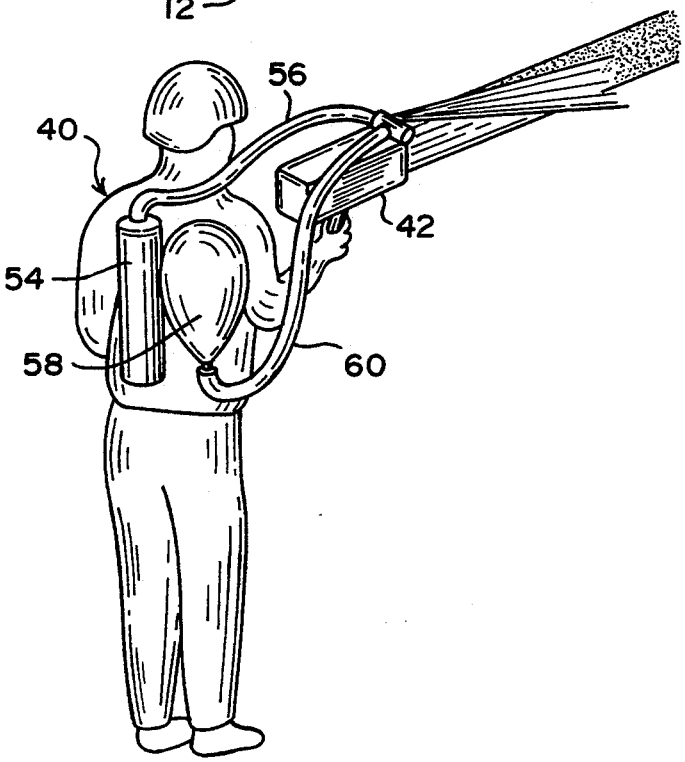
FIG. 3

TOY WITH SIMULATED FORCE DISCHARGE

BACKGROUND OF THE INVENTION

The desire for enhancement of the realism of toys, models and the like has resulted in many different simulative effects utilizing a variety of different means ranging from relative innocuous light and noise generating devices to potentially dangerous devices such as compressed gas cartridges, firecrackers and the like.

An example of a multiple effect toy is presented in U.S. Pat. No. 4,750,641 issued to Chin-Fu on Jun. 14, 1988. This patent illustrates a toy water pistol wherein an internal sound is generated, water is ejected longitudinally from the muzzle in a continuous stream, and a light bulb mounted at the inner end of the barrel transmits light radially through slots in the barrel remote from the water stream.

SUMMARY OF THE INVENTION

The present invention enhances the realism of toys, models and the like by a simulation of a force or pressure discharge. This discharge simulation can be in the form of a firearm discharge, either for a conventional projectile weapon or a futuristic "laser" weapon; as a simulated exhaust for vehicles with a variety of propulsion systems including jet engines; as the exhaust or discharge of a futuristic flying backpack; and in a multitude of other related environments.

The simulation achieved by the present invention is that of a visible luminous gaseous discharge or burst immediately outward of the simulated source, whether this be forward of a gun muzzle or rearward of a vehicle.

The simulated discharge, while quite realistic in appearance, is non-threatening, safe and non-destructive. The simulative effect, the specific nature of which will be suggested by the particular toy with which it is associated, is achieved by providing a longitudinally directed light beam into which a mist or fine spray of water is directed at an acute and preferably low angle thereto forward of the light source. The droplets of water will individually reflect the light as the water travels both partially along the light beam and at an angle thereto, providing a luminous cloud and/or jet discharge effect. This effect, again in accord with the particular toy involved, can be changed by varying the intensity of the light beam and/or providing a color filter, and varying the spray pattern of the water both as to direction and size of droplets.

Structurally, the system includes a light emitting bulb with reflector encased within a toy and outwardly directed in the direction of discharge, for example rearward of a toy vehicle or forward of a gun muzzle. An energizing system, normally comprising a battery circuit and switch, preferably mounted within the toy itself, powers the bulb as desired, either with a continuous beam or intermittent flashes. The toy will also incorporate a fluid or water reservoir which, through a water supply tube, supplies an atomizing or misting nozzle with fluid, either utilizing a mechanical pump which pressurizes the fluid for transfer and discharge through the nozzle, or a manual pump joined to the nozzle by a separate air tube which, upon manipulation, acts as to draw the water into the nozzle and discharge the water in a pressurized mist or spray.

Additional features of the invention will become apparent as the invention is more fully hereinafter presented.

BRIEF DESCRIPTION OF THE DRAWINGS

FIG. 1 is a side elevational view, with a portion broken away, of a toy vehicle with the discharge system of the invention incorporated therein as the vehicle exhaust system;

FIG. 2 is a top view of the vehicle with the upper portion of the vehicle broken away to illustrate the operating components;

FIG. 3 is a perspective illustration of a toy figure with the discharge system incorporated into a hand-held weapon or the like to simulate the weapon discharge;

DESCRIPTION OF PREFERRED EMBODIMENTS

Figure 4:
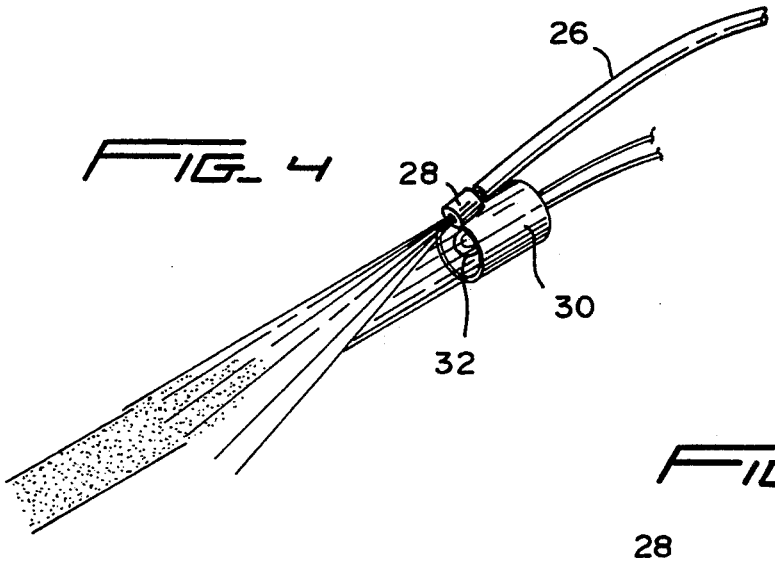
FIG. 4 is a partial perspective view of the discharge system illustrating the water nozzle and the lamp mount.

Referring now more specifically to the drawings, FIGS. 1 and 2 illustrate a toy or model vehicle body 10 which is intended to typify any of a variety of known vehicle configurations. The vehicle body, in the case of a road vehicle, will normally mount wheels 12 for a hand or motor propelling of the vehicle.

In the illustrated construction, a motorized gear box 14 directly drives the rear wheels 12 and, through an eccentrically mounted crank arm 16 drives the piston 18 of a water pump 20. The water pump 20 communicates with a fluid or water reservoir 22, also preferably mounted within the vehicle body, by a water inlet tube 24. The discharge of the pump 20 communicates with a water outlet tube 26 which extends to the rear of the vehicle 10 and mounts a discharge nozzle 28. The nozzle is preferably a misting nozzle capable of atomizing or misting the water to discharge in a fine spray.

Immediately adjacent and preferably directly underlying the nozzle 28 is a light emitting unit including, preferably, a tubular member or mount 30 opening outward at one end thereof and defining a discharge port, for example rearward with regard to the vehicle body 10 in the manner of, and as desired simulating the appearance of, an exhaust pipe.

Figure 5:
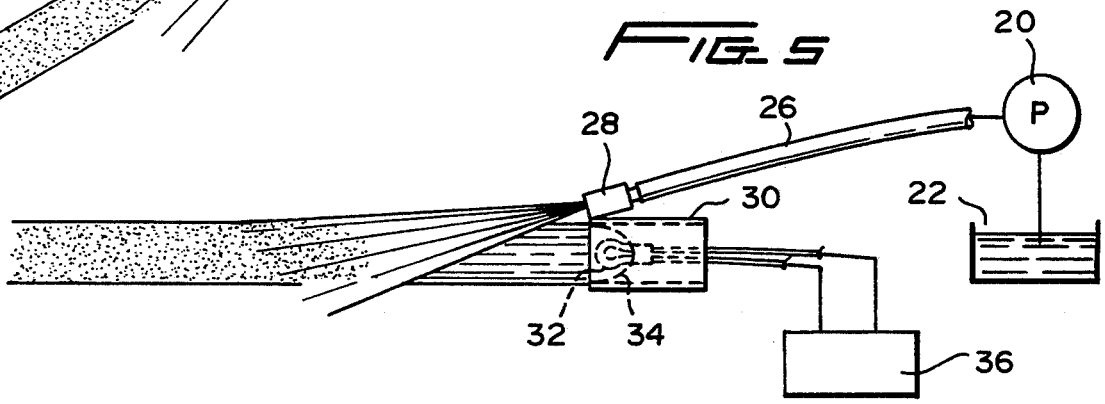
FIG. 5 is a schematic illustration of the system illustrating the power and supply sources as they might be incorporated into the vehicle of FIGS. 1 and 2.

Noting FIGS. 4 and 5 in conjunction with FIGS. 1 and 2, the tubular member 30, adjacent the outwardly directed open end thereof, mounts a light-emitting bulb or lamp 32 backed by an appropriate reflector 34 to cast a beam of light. The light 32 is in circuit with an appropriate power source 36, preferably a battery or battery pack which can also provide the power source for the motorized gear box 14.

The reflector 34 is preferably parabolic whereby light rays reflected therefrom are substantially parallel to provide a generally linear beam.

The lamp 32 is so mounted and directed relative to the toy body 10 as to correspond with a force or pressure discharge which might normally be anticipated by the nature of the item represented by the toy. For example, in the illustrated toy vehicle, the light beam is so oriented as to correspond to the exhaust of the vehicle, and as such, is linearly directed from the rear of the vehicle.

The nozzle 28, mounted immediately above the mounting tube 30, is angled in a manner whereby the discharge holes or jets thereof direct the discharging spray at an acute, preferably low, angle to the light beam so as to intersect the light beam outward of the source or rearward of the vehicle body 10. The acute angle of the intersecting beam and spray provide a substantial area wherein the spray droplets intersect and/or travel along the length of the beam.

The light, in turn, reflects off the individual droplets, even as the droplets move beyond the exact linear extent of the beam, to provide a diffused pattern to the light which produces an appearance which presents a highly effective simulation of a gaseous discharge. The actual effect achieved can be easily changed or varied. For example, should a "flame" discharge be desired, as with a flame thrower or an aircraft jet engine, the light-emitting assembly can be provided with a red filter. Other variations can be achieved by a modification in the intensity of the light beam and changes in the intensity and nature of the water discharge.

The activation of the vehicle can be achieved in any manner associated with such toy vehicles, including a vehicle mounted switch, remote radio control, or the like. As desired, a timing mechanism may be incorporated whereby the visible "exhaust" only occurs during periods of vehicle acceleration as the vehicle moves into "overdrive."

FIG. 3 illustrates another form of toy 40 wherein the discharge simulating system is incorporated into a weapon or armament 42, which can either be hand held or otherwise manipulated by the toy figure.

Figure 6:
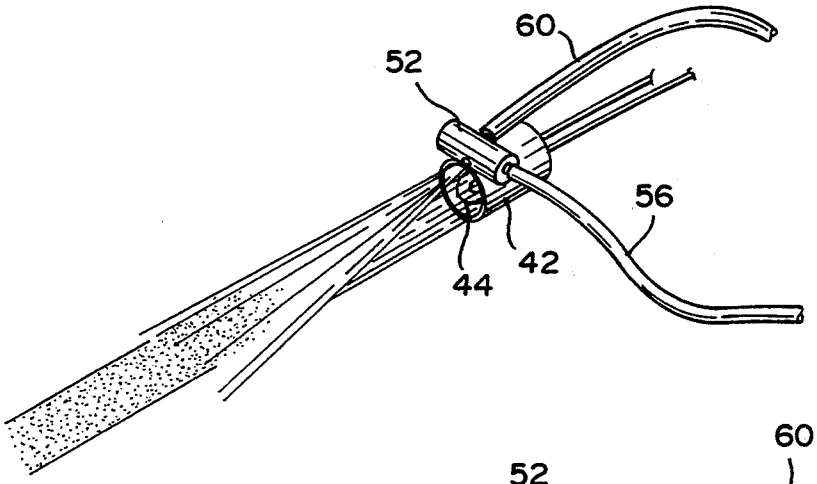
FIG. 6 is a partial perspective view of the water nozzle and bulb mount of the system of the invention as it is contemplated for the toy figure of FIG. 3.
Figure 7:
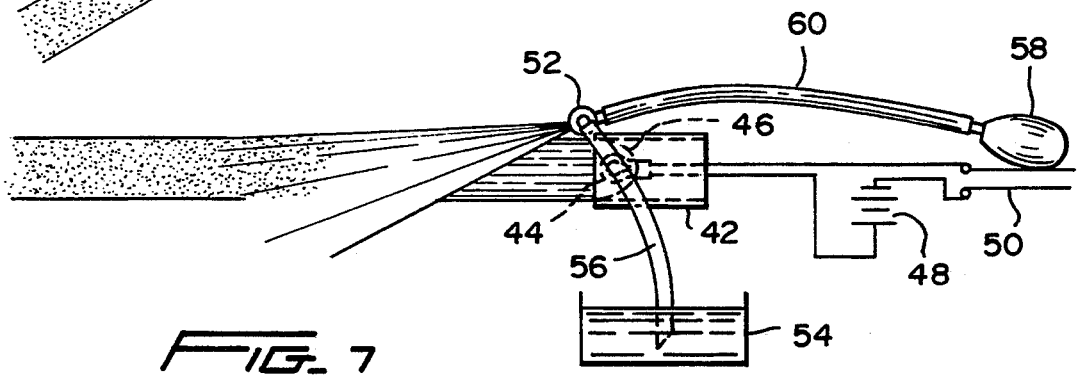
FIG. 7 is a schematic illustration of this system with power and supply sources, and manual activation means.

In this embodiment, and noting FIGS. 6 and 7, the light emitting bulb or lamp 44, and the surrounding reflector 46, are mounted at the muzzle end or discharge port of the tubular body, which in turn defines or simulates the barrel of the weapon 42, for a linearly outwardly directing of the light beam. The electrical circuit for the lamp 44 includes a power source or battery 48 and a manual switch 50.

The water nozzle 52 mounts directly over the barrel of the weapon at the muzzle end with the discharge ports or holes outwardly directed along an acute axis relative to the light beam for a low angle intersection of the discharging water spray with the light beam forward of the muzzle end of the weapon 42.

The nozzle communicates with a water reservoir 54, which may be in the manner of a backpack or cylinder mounted on the toy figure, by a water inlet tube 56. A manual elastomeric squeeze bulb or pump 58 is communicated with the nozzle 52 by an air tube 60 in a manner whereby repeated squeezing and release of the squeeze bulb 58 will produce a discharge of air through the nozzle 52 with water, through the water inlet tube 56, being drawn into and discharged with the airflow in the manner of a conventional hand pumping assembly. Depending upon the nature of the toy FIG. 40, an appropriate squeeze trigger or handle can replace the squeeze bulb 58. Further, and as suggested in the schematic illustration of FIG. 7, the squeeze bulb 54 can be so mounted relative to the electric switch 50 as to, by a single manual manipulation, simultaneously dispense the water and project the light beam. In this manner a more realistic simulation of a repeated "firing" of the weapon will be achieved.

As noted with the vehicle, the actual appearance of the discharge can be varied, for example by the use of an appropriate filter positioned over the light bulb.

While not specifically detailed, it is to be appreciated that appropriate controls and switches can be provided as required by the particular nature of the toy. Further, the batteries are to be so mounted as to be readily replaced, and the water reservoirs are to be so located as to be easily replenished, for example as on conventional water guns.

From the foregoing, it will be appreciated that the enhanced realism of a toy is uniquely achieved by combining, within the toy, means for producing an outwardly directed light beam in conjunction with a liquid discharge, preferably in the form of a fine mist, along a path wherein the liquid discharge intersects and is coincident with the light beam for a substantial portion thereof outward of the toy body. The partial diffusing of the light beam and a reflection of the light by the multiple water droplets simulates the exhaust of a vehicle, the discharge of a jet engine, the discharge of armaments, and the like.

It is to be recognized that the word toy as used herein is intended to include toys, models, reproductions, and like simulations.

The foregoing specifically described embodiments are illustrative of the invention. As other embodiments incorporating the inventive features of the invention may occur to those skilled in the art, it is to be appreciated that the disclosed embodiments are not to be considered as limitations on the scope of the invention.

I claim:

1. A toy representative of an item normally incorporating means for emitting a discharge, said toy including a system for the simulation of a force discharge as a realism enhancing display for said toy, said toy including a body, discharge port means on and outwardly directed relative to said body, said system for simulation of a force discharge comprising light emitting means mounted within said toy and aligned with said discharge port means for the emission of a linear light beam longitudinally outward of said body, means for electrically energizing said light emitting means, a discharge nozzle for liquid mounted to said toy laterally of said discharge port and outwardly directed relative to said body for emission of a liquid mist discharge, a liquid supply, pump means for pressurizing liquid from said supply and for discharging said pressurized liquid to define said liquid discharge, said discharge nozzle being positioned at an intersecting angle relative to said light emitting means and said discharge port wherein said liquid discharge is directed along a path intersecting and crossing said light beam outward of said toy body and wherein said liquid discharge is coincident with only a portion of said light beam outward of said toy body to partially diffuse and reflect said light beam and combine therewith to define said simulation of a force discharge.

2. The toy of claim 1 wherein said discharge nozzle is directed at an acute angle to said light emitting means.

3. The toy of claim 1 wherein said pump means comprises a manual pump, an air line communicating said manual pump with said nozzle and a liquid line communicating said liquid supply with said nozzle whereby manual pressure on said pump effects a pressurized discharge of air with liquid drawn thereto and entrained therein.

4. The toy of claim 1 wherein said toy body defines a toy vehicle, said discharge port means simulating an exhaust pipe for a vehicle propulsion system, said simulation of a force discharge simulating a vaporous discharge of an exhaust of a vehicle propulsion system.

5. The toy of claim 1 wherein said toy body further comprises a simulated propulsion system including said port means, said discharge nozzle comprising a misting nozzle, said emission of said light beam and said liquid discharge emitting from said simulated propulsion system and simulating a gaseous discharge for said simulated propulsion system.

6. The toy of claim 1 wherein said toy body further comprises a simulated weapon including said port means, said light beam and said liquid discharge emitting from said simulated weapon and simulating a gaseous discharge for said simulated weapon.

* * * * *